US007047853B2

(12) United States Patent
Brockhage

(10) Patent No.: US 7,047,853 B2
(45) Date of Patent: May 23, 2006

(54) SHEARS

(76) Inventor: Donald J. Brockhage, 1137 Park Brook Ct., Milpitas, CA (US) 95035

( * ) Notice: Subject to any disclaimer, the term of this patent is extended or adjusted under 35 U.S.C. 154(b) by 0 days.

(21) Appl. No.: 10/879,313

(22) Filed: Jun. 28, 2004

(65) Prior Publication Data

US 2004/0231165 A1 Nov. 25, 2004

Related U.S. Application Data

(63) Continuation of application No. 10/209,340, filed on Jul. 30, 2002, now Pat. No. 6,754,961.

(51) Int. Cl.
*B26D 3/00* (2006.01)
*B26B 13/26* (2006.01)

(52) U.S. Cl. ..... 83/56; 83/13; 30/190; 30/249; 30/251; 30/254; 30/257

(58) Field of Classification Search ..... 30/190, 30/251, 254, 257, 228, 249
See application file for complete search history.

(56) References Cited

U.S. PATENT DOCUMENTS 3,034,214 A * 5/1962 Bossé ..... 30/257
5,074,046 A * 12/1991 Kolesky ..... 30/259
6,178,643 B1 * 1/2001 Erbrick et al. ..... 30/228

OTHER PUBLICATIONS

U.S. Appl. No. 10/209,340, Donald J. Brockhage, Priority Claim.

* cited by examiner

*Primary Examiner*—Allan N. Shoap
*Assistant Examiner*—Carolyn Blake
(74) *Attorney, Agent, or Firm*—Donald R. Boys; Central Coast Patent Agency, Inc.

(57) ABSTRACT

A shearing tool has a fulcrum shaft, a first blade rigidly attached to the fulcrum shaft, a first element also rigidly attached to the fulcrum shaft and spaced apart on the shaft from the first blade, and a second blade contiguous with a second element, the second blade pivoted on the fulcrum shaft at one end of the blade, and between the attachment positions of the first blade and the first element such that relative rotation of the first and second elements causes relative rotation of the first and second blades producing a shearing action.

12 Claims, 6 Drawing Sheets

SHEARS

Figure 1A:
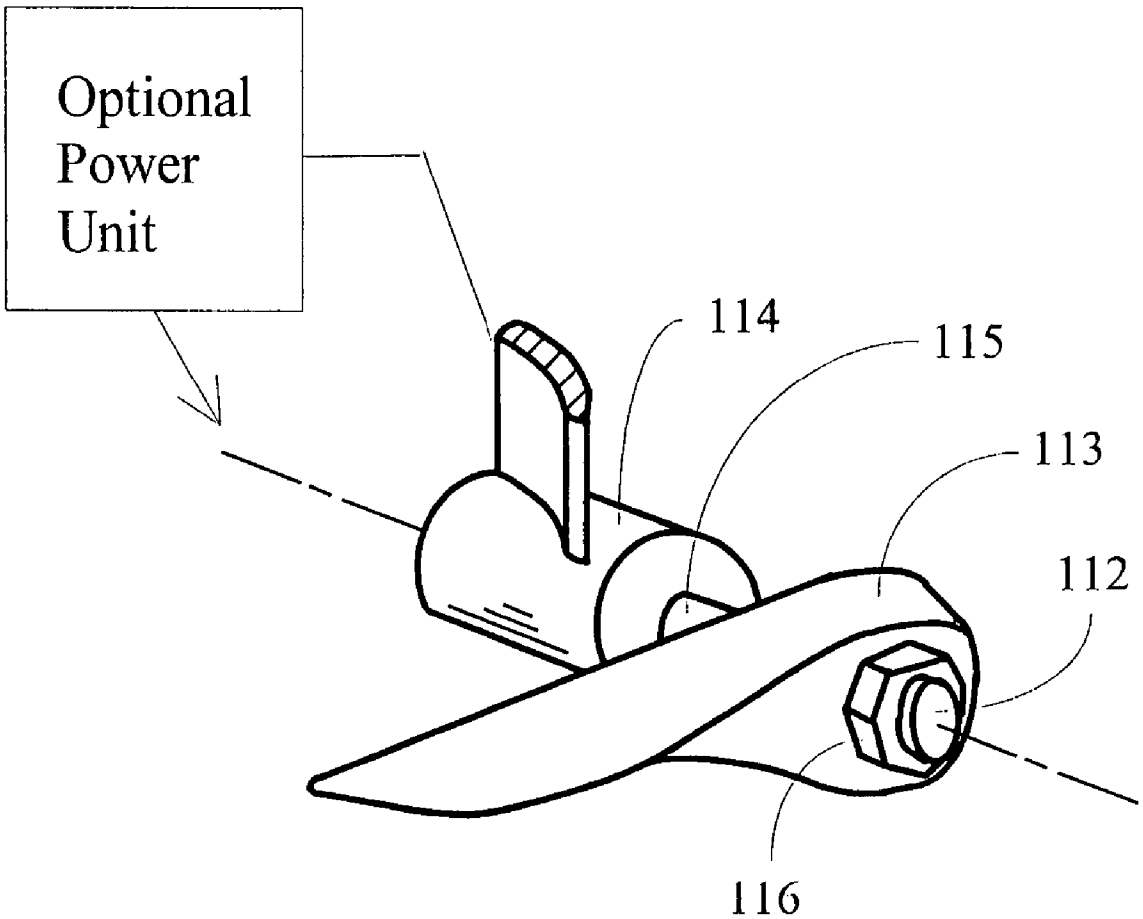

This is a Continuation of Application Ser. No. 10/209,340, filed Jul. 30, 2002, now U.S. Pat. No. 6,754,961.

FIELD OF THE INVENTION

The present invention is in the field of metalworking and pertains to cutting tools, particularly to an improved method and apparatus for shearing metal and other sheet materials used to manufacture parts and systems.

BACKGROUND OF THE INVENTION

In the art of metalworking, a very common operation is the shearing of metal or some other sheet material as performed by a shear tool. Sheared products are typically used as components in other processes of fabrication. In some cases sheared components represent finished pieces that need no further manufacturing. Shearing operations are to some extent dangerous and, depending on the size of job and type of shear equipment, have certain rules that must be followed for maintaining safety during operation. For example, in current art hand shearing, a user grasping a conventional shear tool and attempting a shearing action on a work piece invariably has his or her hands at or near the material cutting plane of the work piece, thus interfering with the material being sheared. Usually heavy gloves are required to protect against newly sheared material edges, as well as safety glasses to protect an operator's eyes when operating a shear tool in a manufacturing domain.

In private, a shear operator takes whatever precaution he or she deems sufficient during shearing operations. Many lacerations and occasionally more serious injuries such as inadvertent amputations have been documented as resulting from shearing operation accidents both in the metalworking industry and in the private sector.

Therefore, what is clearly needed is an improved shearing apparatus that enables an operator to keep his or her hands above and out of the way of the cutting surfaces of the shear or the sharp edge of the material being sheared. Such an improved apparatus would cause fewer injuries and would also provide for more freedom of direction in a shear path through the material being sheared.

SUMMARY OF THE INVENTION

In a preferred embodiment of the present invention a shearing tool is provided, comprising a fulcrum shaft, a first blade rigidly attached to the fulcrum shaft, a first element also rigidly attached to the fulcrum shaft and spaced apart on the shaft from the first blade, and a second blade contiguous with a second element, the second blade pivoted on the fulcrum shaft at one end of the blade, and between the attachment positions of the first blade and the first element such that relative rotation of the first and second elements causes relative rotation of the first and second blades producing a shearing action.

In some preferred embodiment the first element is a frame element of the shearing tool, and the second element is a link or handle contiguous with the second blade at a point on the blade side of the fulcrum, causing cut material to flow under operating elements and a user's hand. Also in some preferred embodiments the second element is a contiguous link and handle arranged such that urging the handle toward the frame element provides the relative rotation producing a shearing action. In still further embodiments the first element is a frame element of the shearing tool, and the second element is a link or handle contiguous with the second blade at the one end of the blade pivoted to the fulcrum shaft. In yet other embodiments the second element is a part of a multi-link assembly for providing a mechanical advantage in rotating the second blade on the fulcrum shaft.

In some cases the first element comprises a first link contiguous with a first handle, the second element comprises a second link contiguous with a second handle, and the second link joins the second blade on the blade side of the fulcrum away from the one end pivoted at the fulcrum shaft. Also in some cases the second link joins the second blade at the one end pivoted at the fulcrum shaft.

In still other embodiments the second element comprises a second link contiguous with a second handle and the first element is a part of a multi-link assembly connected to a first handle for providing a mechanical advantage in rotating the second blade on the fulcrum shaft. In still further embodiments a powered unit provides the relative rotation between the first and the second blades.

In another aspect of the invention a method for shearing sheet material is provided, comprising the steps of (a) rigidly attaching a first blade to a fulcrum shaft; (b) rigidly attaching a first element to the fulcrum shaft, at a position on the shaft leaving a space between the first blade and the first element; (c) pivotally mounting a second blade having a contiguous second element to the fulcrum shaft at a first end of the blade and in the space between the first blade and the first element; and (d) rotating the second element relative to the first element, causing relative rotation between the first and the second blades to shear the sheet material.

In preferred embodiments the first element is a frame element of the shearing tool, and the second element is one of a link or handle contiguous with the second blade on the blade side of the fulcrum. Also in some preferred embodiments the second element is a contiguous link ending in a handle arranged such that urging the handle toward the frame element provides the relative rotation to shear the sheet material. In still further embodiments the first element is a frame element of the shearing tool, and the second element is a link or handle contiguous with the second blade at the first end of the blade pivoted to the fulcrum shaft.

In yet other embodiments of the invention the second element is a part of a multi-link assembly for providing a mechanical advantage in rotating the second blade on the fulcrum shaft. In still other embodiments the first element comprises a first link contiguous with a first handle, the second element comprises a second link contiguous with a second handle, and the second link joins the second blade on the blade side of the fulcrum.

In some cases the second link joins the second blade at the first end pivoted at the fulcrum shaft. In still other cases the second element comprises a second link contiguous with a second handle and the first element is a part of a multi-link assembly connected to a first handle for providing a mechanical advantage in rotating the second blade on the fulcrum shaft. In yet other cases there is a step for applying a powered unit to cause the relative rotation between the first and the second blades to shear the sheet material.

In embodiments of the invention described below in enabling detail, for the first time a shearing tool is provided that allows cutting of all sorts of sheet materials with substantially improved function and safety.

BRIEF DESCRIPTION OF THE DRAWING FIGURES

FIG. 1*a* is a perspective view of a portion of a shearing apparatus according to an embodiment of the present invention.

Figure 1B:
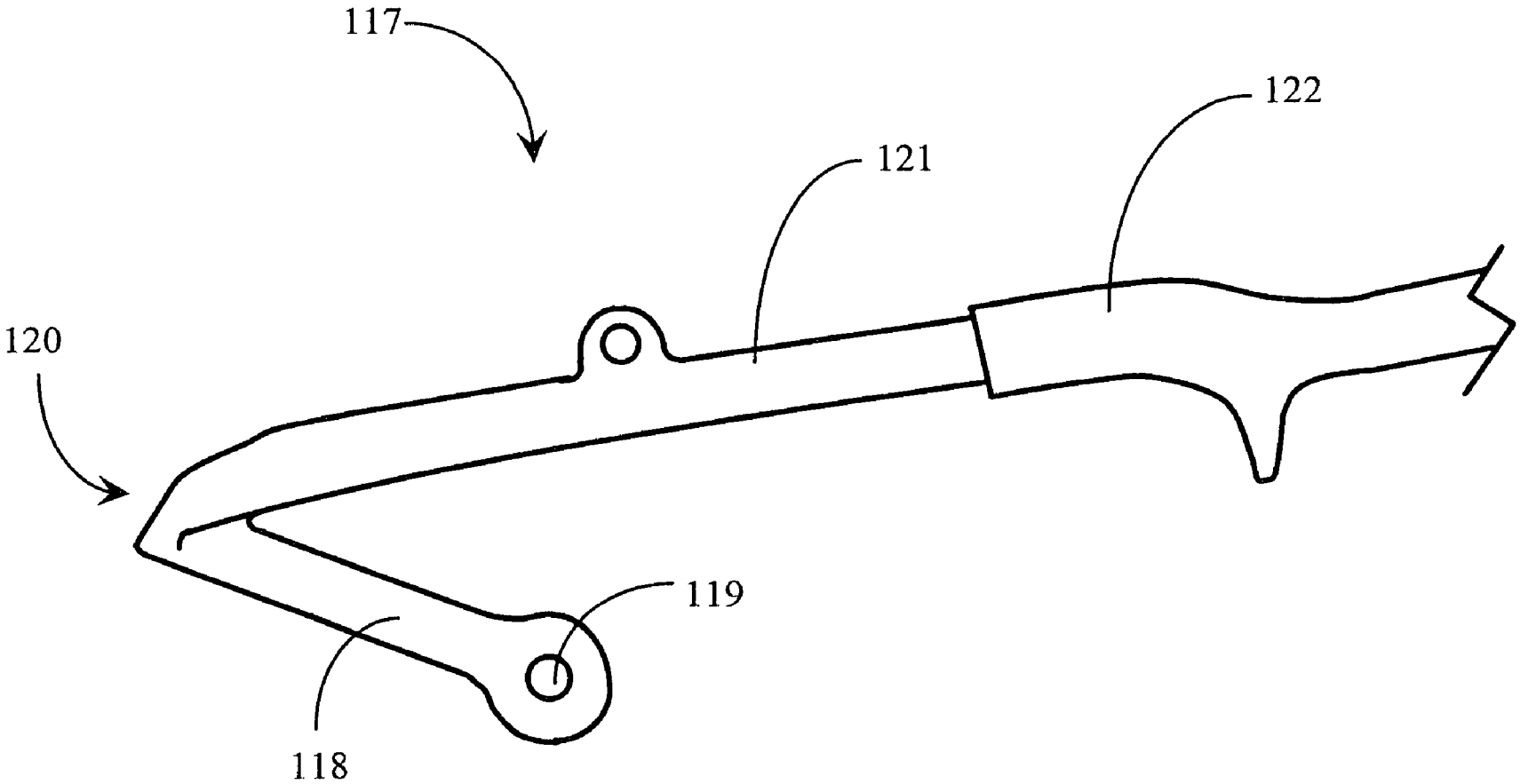

FIG. 1*b* is an elevation view of another portion of a shearing apparatus according to an embodiment of the invention.

Figure 1C:
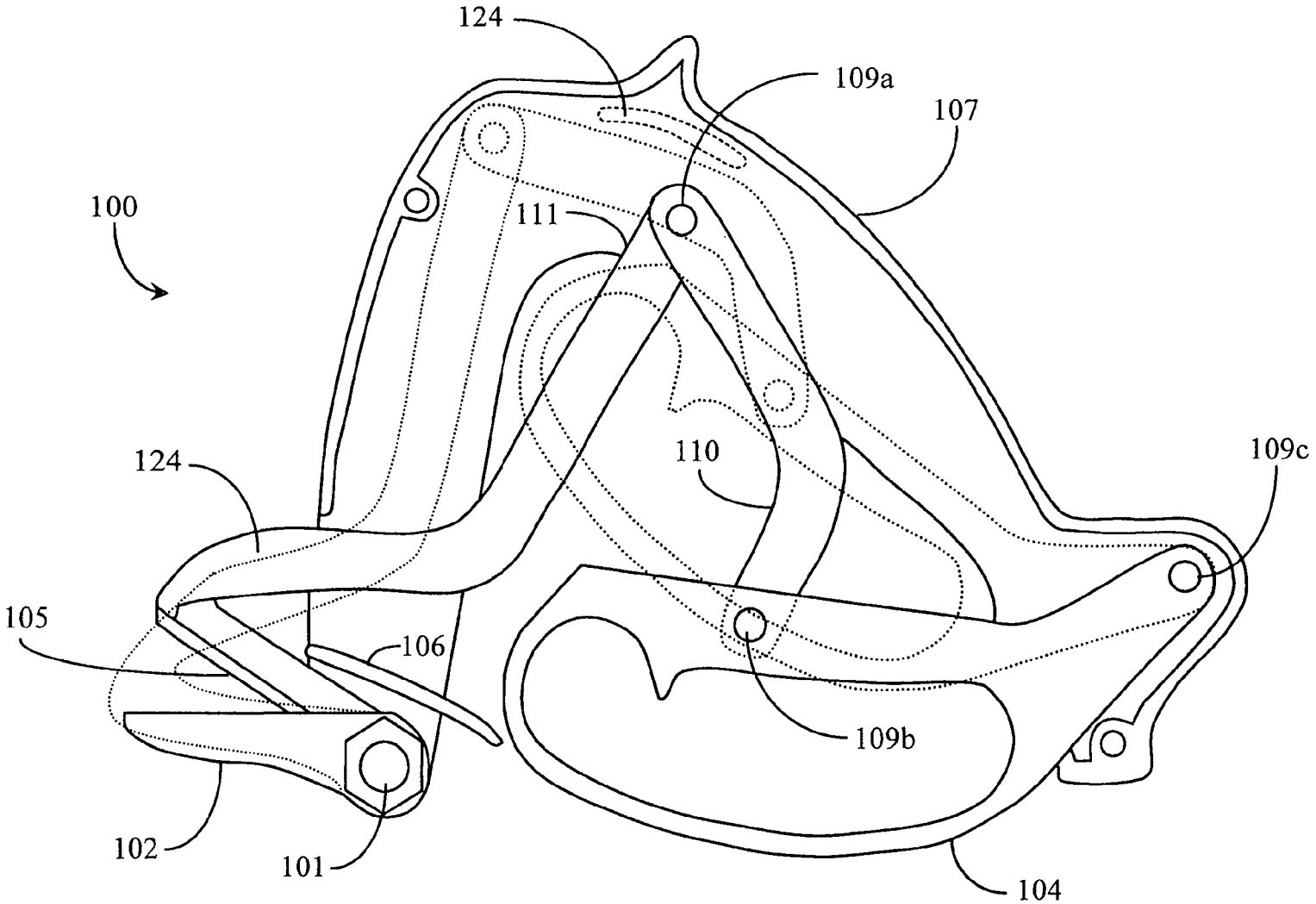

FIG. 1*c* is an plan elevation view of a shear tool according to an embodiment of the present invention.

Figure 2A:
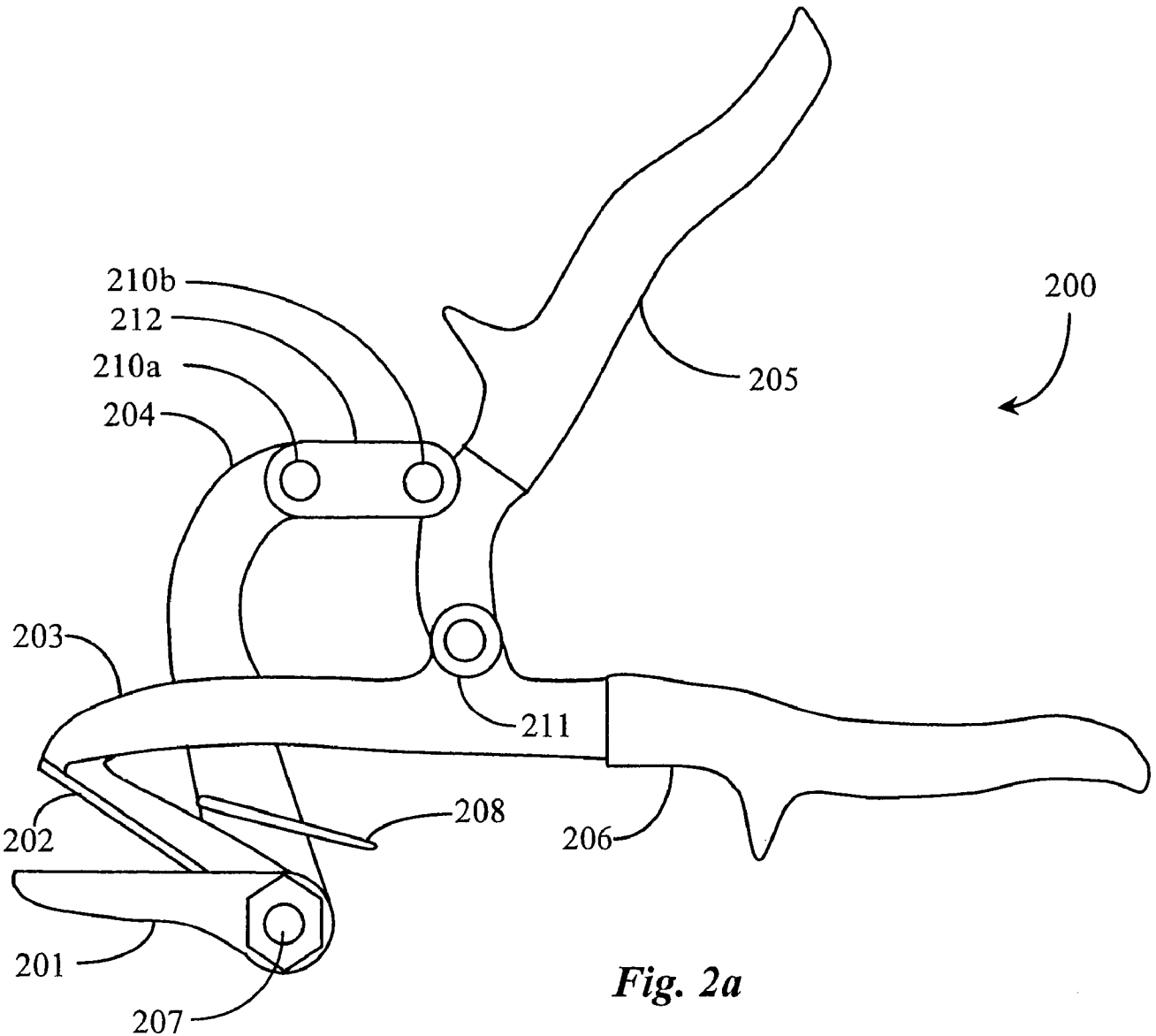

FIG. 2*a* is an elevation view of a shear tool according to an alternative embodiment of the present invention.

Figure 2B:
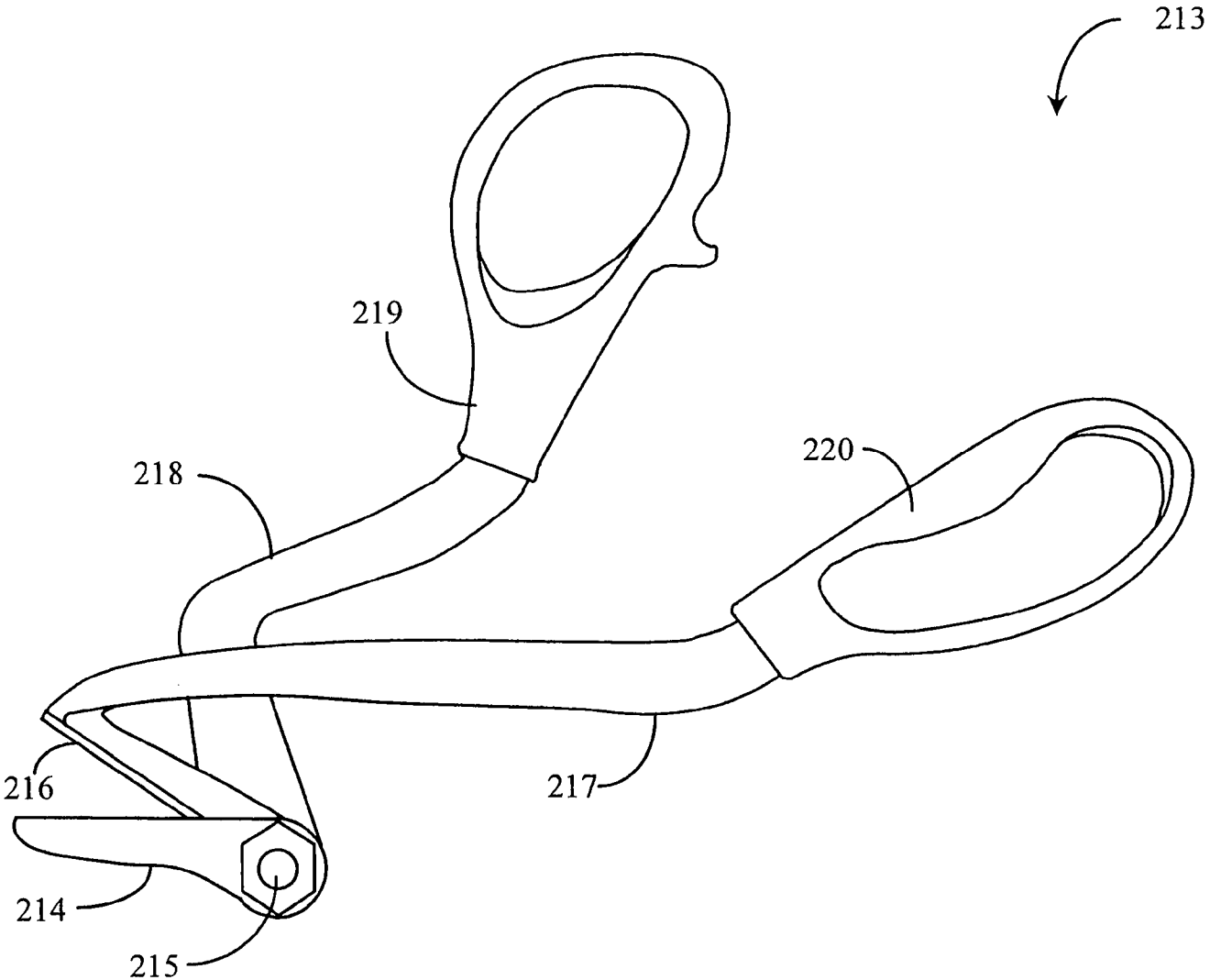

FIG. 2*b* is an elevation view of a shear tool according to another alternative embodiment of the present invention.

Figure 2C:
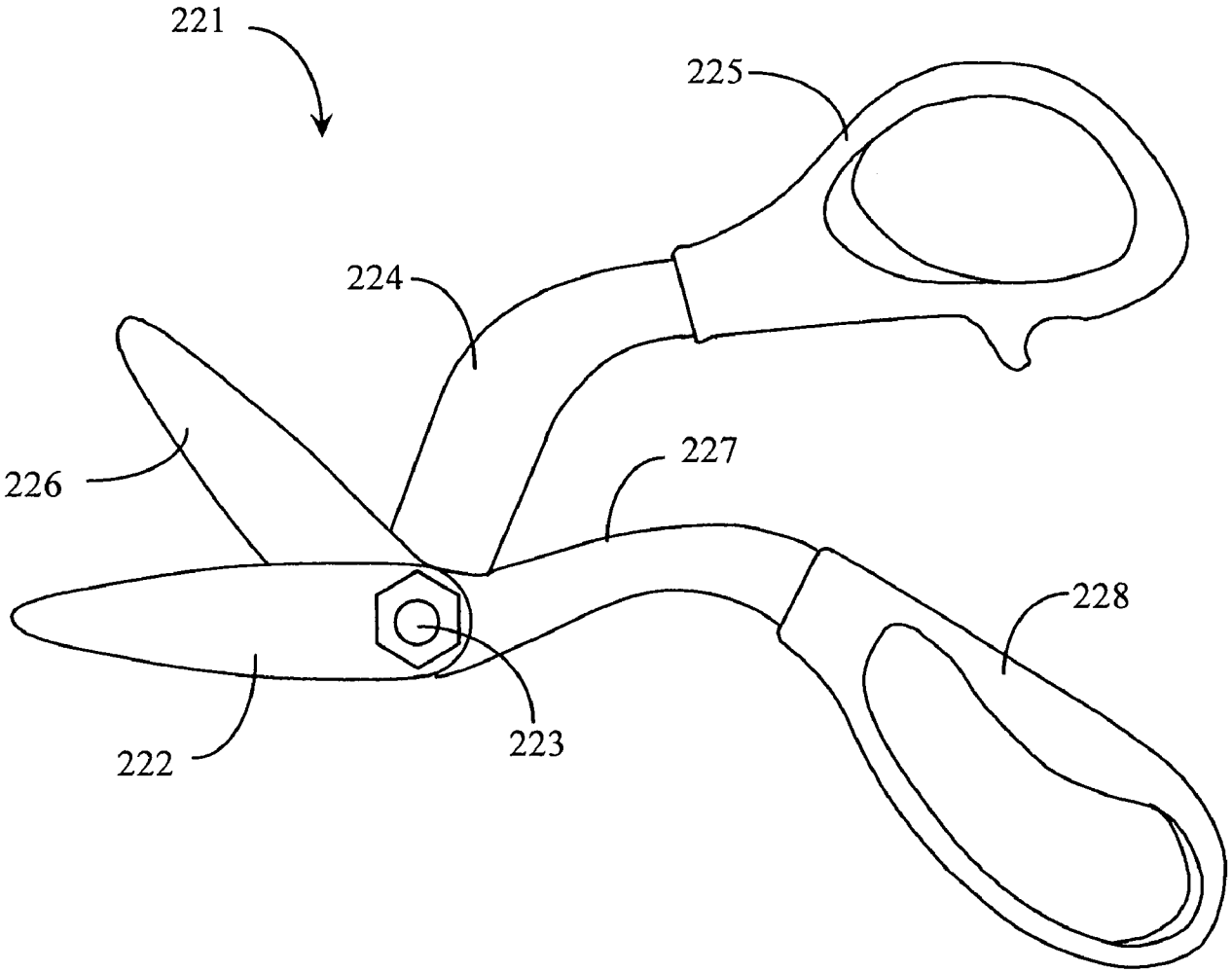

FIG. 2*c* is an elevation view of a shear tool according to yet another alternative embodiment of the present invention.

DESCRIPTION OF THE PREFERRED EMBODIMENTS

The inventor, in a preferred embodiment of the present invention, provides an improved shearing apparatus that enables an operator to shear material without getting his or her hands involved near the cutting plane or in the path of the shear material during cutting.

A core concept in embodiments of the present invention involves the fulcrum of opposed shearing blades. The fulcrum in a shearing device or apparatus is typically a pin or shaft upon which the blades of the device relatively pivot. In embodiments of the invention a handle, link or body of the shearing apparatus is rigidly fixed to the fulcrum pin at one end of the pin, and a first shear blade is similarly fixed to the fulcrum pin at an opposite end of the pin from the handle, link or body. Between the positions where the handle, link or body and the fixed blade are rigidly mounted to the pin, a length of the pin is provided upon which a second blade pivots relative to the first blade. A second handle or handle link attaches to an end of the second blade opposite the end pivoted on the fulcrum pin, and movement of the first handle, link or body relative to the second link or handle causes the relative motion of the blades to create a shearing action.

FIG. 1*a* is a perspective view of a portion of a shearing apparatus in a preferred embodiment of the present invention. This portion of the shearing apparatus is common to many embodiments of the invention, and can be applied to a variety of different shearing apparatus, both hand-operated and powered.

In FIG. 1*a* a fulcrum pin 112 joins a handle, link or body 114 and a shearing blade 113. Both are joined to fulcrum pin 112 in a rigid manner, to prevent relative rotation between the pin and either blade 113 or part 114. A space 115 is left between the part 114 and the rigidly-attached blade 113. In different embodiments different methods of attachment may be used, such as press fitting, welding, soldering, and the like. In this example blade 113 is fastened by a nut 116.

Space 115 between part 114 and blade 113 is for rotational mounting of a second blade, which may be attached to a link or other element to cause it to rotate on pin 112 relative to fixed blade 113.

FIG. 1*b* illustrates a contiguous element 117 comprising both a blade 118 and a link 121, in one of many arrangements for a rotational blade integrated with an operating element. Blade 118 has an end with a bearing through-hole 119 sized to rotate freely on fulcrum pin 112 of FIG. 1*a*, and link 121 is joined to blade 118 at the end of the blade opposite the end that pivots on the fulcrum pin. Joining the operating element (link 121 in this case) to the blade forward of the fulcrum forces cut material to flow under the operating elements and the user's hands.

In embodiments of the invention integrated element 117, or similar elements, are assembled with hole 119 engaged with the fulcrum pin (FIG. 1*a*) in the space 115. Handle 122 is provided for operating, that is, causing blade 118 to rotate on the fulcrum pin, which causes the blade pair to engage along the respective cutting line. Also in various embodiments of the invention the operating element may attach to the pivoting link at any of various positions along the blade forward of the fulcrum. IT is not necessary that the attachment be at the end of the blade.

Different exemplary embodiments using the arrangement described with reference to FIGS. 1*a* and 1*b* are described in enabling detail below. It will be seen that the unique arrangement described allows the users hands to be well above the cutting operation, and above the disposition of separated pieces in operation.

FIG. 1*c* is an elevation view of a tool 100 according to an embodiment of the present invention. Shear tool 100 is an overhand shearing tool, meaning that when an operator shears with tool 100 the hand position of the operator is always well above the material plane and cutting path of the shear tool. Shear tool 100 has, in this embodiment, a body 107, comprising 2 halves, only one half of which is shown in this view to be able to show the inner components of tool 100. Body 107 is typically manufactured from durable material such as steel, aluminum or from other durable metals or plastic materials.

Shear tool 100 has a lower shear blade 102 provided as a fixed shear blade relative to body 107. Blade 102 is analogous to blade 113 of FIG. 1*a*, and body 107 is analogous to element or part 114 of FIG. 1*a*. Both are fixed to bearing shaft 101, which is analogous to pin 112 of FIG. 1*a*.

An upper shear blade 105 is provided as a movable shear blade, and is analogous to blade 118 of FIG. 1*b*. In operation, upper blade 105 moves against lower blade 102 to provide cutting or shearing action. Upper shear blade 105 is pivotally, that is rotationally, mounted to bearing shaft 101 adjacent to blade 102.

Upper shear blade 105 is contiguous with a link 111 joined to the end of blade 105 away from the pivoting end, and link 111 is pivotally attached to an intermediate link 110 by a link pin 109*a*. Intermediate arm 110 is, in turn, pivotally attached to a handle 104 by a link pin 109*b*. Handle 104 is pivotally attached to shear-body 107, also by a link pin 109*c*. Link pins 109*a–c* may any type of pin fastener typically used for connecting rotatable arms or links, so long as the links are durable enough to withstand the force of shearing.

A user grasps body 107 and handle 104 with the fingers through the opening in the handle, and operation is by closing handle 104 toward body 107, which causes link 111 to rotate counterclockwise with a mechanical advantage, rotating blade 105 as well. Rotation of blade 105 relative to fixed and adjacent blade 102 produces the shearing action.

The solid-line boundaries of shear blade 105, arms 111, and 110, and handle 104 represent an open position before exerting force to produce a shearing action. These same components are represented by a boundary of broken lines to represent the closed position of the system after exerting sufficient force to shear a work piece. Material sheared or to be sheared is not shown to avoid confusion in the drawing. Although not specifically illustrated, the open position of shear tool 100 is maintained in some embodiments through use of one or more springs.

It is clearly seen that the user's hand is well above the cutting action and the material sheared. In this and many other embodiments a material foot 106 as part of the body, or rigidly attached to the body, provides further assurance of keeping material below the user's hand.

In some cases, depending largely on characteristics of material to be sheared, spring action may not be sufficient to open the shear blades after a cut is made. For this reason, in many embodiments, a flange 124 shown in FIG. 1*c* in approximate dotted outline, is provided extended from body 107 to one or both sides of the body. With such an appendage a user may hook the thumb under the flange to gain leverage to open the blades as needed.

FIG. 2*a* is an elevation view of a shear tool 200 according to an alternative embodiment of the present invention. Shear tool 200, like tool 100, is a hand-operated shear tool. However, in this example tool 200 has an open design similar to many hand-held shearing tools, with exception of the unique features shared by both tools 100 and 200. Shear tool 200 has a bottom shear blade 201 that is fixedly attached to a bearing shaft 207 just as blade 102 of the device of FIG. 1 is fixedly attached to shaft 101. Link 204 is likewise fixedly attached to shaft 207, and is analogous to link 111 of FIG. 1*c*. Blade 201 and link 204 are attached to shaft 207 spaced apart, just as shown for blade 113 and frame member 114 of FIG. 1*a*, leaving a space for blade 202 as a contiguous part of link 203 to be mounted pivotally to shaft 207 between blade 201 and link 204, such that the cutting edges of the blades mate adjacently.

Link 203 extends to a contiguous handle 206. A second link with a handle 205 is pivotally attached to link 203 at pivot 211 and to link 204 through an intermediate link 212 at pivots 210*a* and 210*b*. There is additionally a material foot 208 analogous to foot 106 of FIG. 1*c*.

A user, by grasping over handles 205 and 206 and bringing the handles together, causes blades 201 and 202 to rotate relatively, creating the blade shearing action. Again, the unique arrangement of the fixed and the pivoted blade allow for the users hands to stay above and away from sheared material, and the foot 208 aids in the separation.

FIG. 2*b* is an elevation view of yet another embodiment of a shearing tool using the elements and arrangements illustrated in FIGS. 1*a* and 1*b*, as also exemplified in the device of FIGS. 1*c* and 2*a*. Shearing tool 213 is implemented in this embodiment without compound linkages as were taught in the embodiments of FIGS. 1*c* and 2*a*. A blade 214 is fixedly attached to shaft 215, as is a link 218 having a handle 219. Blade 216, contiguous with link 217 having a handle 220 pivots on shaft 215. The arrangement has less of a mechanical advantage than the embodiments with compound linkages taught above, but ha advantages of simplicity in design. Again, as before, the same arrangement of a fixed and a pivotal blade is used, as taught above in FIGS. 1*a* and 1*b*, and as exemplified in the embodiments taught above relative to FIGS. 1*c* and 2*a*.

FIG. 2*c* is an elevation view of a shearing tool 221 in yet another embodiment of the present invention. In this embodiment the unique arrangement of a first blade affixed to a blade-pivot shaft and a first link or handle also affixed to the same shaft, but spaced apart to provide a space for a second blade and link or handle to pivot on the same shaft, is retained, as exemplified in FIG. 1*a*. A difference is that, in this particular embodiment, the second blade is contiguous with the second link and handle, but at the back of the blade rather than at the tip of the blade as in the embodiments described above. This embodiment is particularly useful for shearing relatively soft and flexible materials, such as cloth, leather, and the like.

Referring to FIG. 2*c* blade 222 is rigidly attached to shaft 223 as is link 224 ending in handle 225. Link 224 is attached to shaft 223 spaced apart from blade 222, just as is shown in FIG. 1*a*, for which blade 222 is analogous to blade 116, and link 224 is analogous to element 114 contiguous blade 226, link 227 and handle 228 pivots on shaft 223 between the attachment points of blade 222 and link 224. This arrangement again, along with the shapes of the links and handle elements, promotes a shearing operation that allows the operator's hands to stay above the point-of-shearing.

In all of the embodiments of the invention described above with reference to FIGS. 1*a* through 2*c*, the novel arrangement of a pivot shaft having two elements affixed, one being a blade, and spaced apart on the shaft for another blade element to pivot between them, is implemented. Because the hands and wrist are above the work piece in these examples they are kept away from the sharp newly sheared edges of the material reducing the possibility of being cut.

In the manually operated embodiments described above the operator's hand and wrist have more freedom to move using the overhand shear tools of the invention because they are above the work piece and will not be restricted to the space near or between newly cut edges of sheet material. Greater control of the work piece results including more accurate cuts. Moreover, increased force can be applied through the shears to the material being cut because the operator's hand and wrist are not required to work at restrictive angles near or between the edges of the cut material.

The apparatus of the invention can be applied to hand operated shear tools as shown and described, and also to powered shear tools. Powered tools may be provided in alternative embodiments employing various implementations to power the relative rotation and action of the blades of the apparatus, while keeping the novel arrangement taught and described herein in enabling detail. The apparatus of the invention should be afforded the broadest scope under examination. The spirit and scope of the invention are limited only by the claims that follow.

What is claimed is:

1. A shearing tool comprising:

a fulcrum shaft;

a first blade rigidly attached to the fulcrum shaft;

a frame element also rigidly attached to the fulcrum shaft and spaced apart on the shaft from the first blade; and a second blade contiguous with a link the second blade pivoted on the fulcrum shaft at one end of the blade, and between the attachment positions of the first blade and the frame element such that relative rotation of the frame and link causes relative rotation of the first and second blades producing a shearing action;

characterized in that the link is contiguous with the second blade at a point on the blade side of the fulcrum, causing cut material to flow under operating elements and under a user's hand, and further that the link is part of a multi-link assembly for providing a mechanical advantage in rotating the second blade on the fulcrum shaft.

2. The tool of claim 1 wherein the link is a contiguous link and handle arranged such that urging the handle toward the frame element provides the relative rotation producing a shearing action.

3. The tool of claim 1 wherein link is contiguous with the second blade at the one end of the blade pivoted to the fulcrum shaft.

4. The tool of claim 1 wherein the frame element comprises a first link contiguous with a first handle, the link comprises a second link contiguous with a second handle, and the second link joins the second blade on the blade side of the fulcrum away from the one end pivoted at the fulcrum shaft.

5. The tool of claim 4 wherein the second link joins the second blade at the one end pivoted at the fulcrum shaft.

6. The tool of claim 1 wherein the link comprises a second link contiguous with a second handle and the frame element is a part of a multi-link assembly connected to a first handle for providing a mechanical advantage in rotating the second blade on the fulcrum shaft.

7. A method for shearing sheet material, comprising the steps of:

(a) rigidly attaching a first blade to a fulcrum shaft;

(b) rigidly attaching a frame element to the fulcrum shaft, at a position on the shaft leaving a space between the first blade and the frame element;

(c) pivotally mounting a second blade having a contiguous link to the fulcrum shaft at a first end of the blade and in the space between the first blade and the frame element; and (d) rotating the link relative to the frame element, causing relative rotation between the first and the second blades to shear the sheet material;

wherein the link is contiguous with the second blade at a point on the blade side of the fulcrum, causing cut material to flow under operating elements and a user's hand, and further that the link is part of a multi-link assembly for providing a mechanical advantage in rotating the second blade on the fulcrum shaft.

8. The method of claim 7 wherein the link is a contiguous link ending in a handle arranged such that urging the handle toward the frame element provides the relative rotation to shear the sheet material.

9. The method of claim 7 wherein link is contiguous with the second blade at the first end of the blade pivoted to the fulcrum shaft.

10. The method of claim 7 wherein the frame element comprises a first link contiguous with a first handle, the link comprises a second link contiguous with a second handle, and the second link joins the second blade at a point on the blade side of the fulcrum.

11. The method of claim 10 wherein the second link joins the second blade at the first end pivoted at the fulcrum shaft.

12. The method of claim 7 wherein the link comprises a second link contiguous with a second handle and the frame element is a part of a multi-link assembly connected to a first handle for providing a mechanical advantage in rotating the second blade on the fulcrum shaft.

* * * * *